US009526311B1

(12) United States Patent
Schaefer et al.

(10) Patent No.: US 9,526,311 B1
(45) Date of Patent: Dec. 27, 2016

(54) BATTERY POWERED HAIRDRYER

(71) Applicants: Eileen Bonnie Schaefer, Boca Raton, FL (US); Charles Francis Ciaramita, Banner Elk, NC (US)

(72) Inventors: Eileen Bonnie Schaefer, Boca Raton, FL (US); Charles Francis Ciaramita, Banner Elk, NC (US)

(73) Assignee: INCUBATOR GROUP LLC, Boca Raton, FL (US)

( * ) Notice: Subject to any disclaimer, the term of this patent is extended or adjusted under 35 U.S.C. 154(b) by 0 days.

(21) Appl. No.: 15/061,071

(22) Filed: Mar. 4, 2016

(51) Int. Cl.
*A45D 20/08* (2006.01)
*A45D 20/10* (2006.01)

(52) U.S. Cl.
CPC ..... *A45D 20/08* (2013.01); *A45D 20/10* (2013.01)

(58) Field of Classification Search
CPC ..... A45D 20/08; A45D 20/10
See application file for complete search history.

(56) References Cited

U.S. PATENT DOCUMENTS

| | | | | |
|---|---|---|---|---|
| 4,757,183 | A * | 7/1988 | Karey | A45D 20/10 219/543 |
| 5,875,562 | A * | 3/1999 | Fogarty | A45D 20/10 34/97 |
| 6,314,236 | B1 * | 11/2001 | Taylor | A45D 20/10 200/50.01 |
| 8,882,378 | B2 * | 11/2014 | Bylsma | A45D 34/04 401/1 |
| 2012/0125909 | A1 * | 5/2012 | Scheunert | A45D 20/12 219/222 |

* cited by examiner

*Primary Examiner* — Jiping Lu

(57) ABSTRACT

A battery powered hairdryer configured with improved efficiency. The hairdryer is powered by a rechargeable lithium ion battery. The heat from the battery is directly used to heat the forced air created by the hairdryer fan. This is accomplished by situating the battery in the path of the forced air, or by connecting the battery to a heat sink and disposing at least part of the heat sink in the path of the forced air. To further improve efficiency, the fan motor is situated in the path of the forced air. All circuitry within the hairdryer is either disposed in the path of the forced air, or thermally connected to the heat sink which is at least partially disposed in the path of the forced air. In this way, any heat created by the hairdryer's electrical components is used to preheat the forced air within the hairdryer. The preheated air is then further heated by the heating element within the hairdryer.

10 Claims, 2 Drawing Sheets

BATTERY POWERED HAIRDRYER

TECHNICAL FIELD

The present invention relates to a battery powered hairdryer, and more particularly a hairdryer powered by a rechargeable lithium ion battery.

BACKGROUND

Traditional hairdryers are powered by an alternating current (AC) power source. A hairdryer of this type requires a cord attached to an electrical outlet usually in a building. Being bound by an electrical cord, traditional hairdryers have almost no mobility. Corded AC powered hairdryers demand a large amount of electricity to operate. By nature, hairdryers are used in wet areas and the user is inherently risking electrocution. AC power is very dangerous when in contact with water. The cords of traditional hairdryers are also easily tangled and messy. The electrical cords themselves can be difficult to maneuver and are a hazard.

The present invention addresses these and other problems of prior art hairdryers.

SUMMARY OF THE INVENTION

The battery operated hairdryer of the present invention uses a rechargeable lithium ion battery because of the battery's high energy density. Hairdryers require a great amount of power, and lithium ion batteries are the only batteries currently available that approach the required energy while remaining light enough to keep the hairdryer easily portable and maneuverable. The major drawback of lithium ion batteries for most uses is their propensity to get hot during use. In the present invention, the battery's waste heat is harnessed in a heat sink or through forcing air over the battery itself. This waste heat preheats the forced air, so less heat is required from the heating element, and in turn the heating elements draw less power from the battery.

To increase the efficiency of the hairdryer of the present invention, the heat sink may also be used to cool the other electrical components within the hairdryer. The electrical components are either mounted to the heat sink or the forced air blows directly over the electrical components. The largest inefficiencies in nearly all electrical devices are losses manifested in heat. By using this heat to preheat the forced air, before it is further heated by the heating element, the hairdryer of the present invention is designed to optimize electrical efficiency. Further, cooling the electrical components will allow them to work at a more optimal efficiency and last longer.

A printed circuit board (PCB) is used to control the electrical components of the present invention. The PCB greatest inefficiency is unintended resistance that creates heat. Therefore, the PCB may be mounted to the heat sink or the forced air flows directly over the PCB.

An at least one supercapacitor is used to initially heat the heating element. The greatest amount of the energy from the battery is used in initially warming the heating element from ambient temperature to its heating temperature. To minimize drain on the battery, an at least one supercapacitor is used for the initial heating of the heating element. The at least one supercapacitor is charged while the hairdryer is plugged into an AC power source for recharging the rechargeable lithium ion battery. This at least one supercapacitor may also be mounted to the heat sink or the forced air blows directly over the at least one supercapacitor.

The fan motor will also experience inherent electrical losses in the form of heat. These losses are harnessed in the present invention by placing the motor on the heat sink or by blowing the forced air directly over the fan motor.

The hairdryer has two major housing components; a handle and a head. The head is divided into three portions. The first portion is an inlet casing containing the fan to create the forced air. The second portion is a middle portion that contains the heat sink cooling fins or heat producing electrical components. The third portion is a tapered outlet nozzle.

The head of the hairdryer of the present invention is shaped in such a way so as to minimize the speed of the forced air through cooling fins of the heat sink or along the heat producing electrical components and past the heating element. The Continuity Equation of fluids states in general terms that $A_1V_1=A_2V_2$; where A=area and V=velocity. In light of this physical property of fluids, the diameter of the head is expanded from the inlet casing of the head of the hairdryer to the middle portion containing the cooling fins of the heat sink or the heat producing electrical components and the heating element. In this way, the thermal exchange between the cooling fins of the heat sink or the heat producing electrical components and the heating element to the cooler forced air is increased. Due to the decreased velocity of the cooler forced air, the contact time between the forced air and these elements will increase and the thermal exchange will also increase.

To further take advantage of the Continuity Equation of fluids, the outlet nozzle of the head of the hairdryer has a smaller diameter than the diameter of the inlet casing of the head of the hairdryer and a much smaller diameter than the middle portion of the head of the hairdryer. Therefore, the velocity of the forced air at the outlet nozzle of the head of the hairdryer is greater than the velocity at any other point in the head of the hairdryer. By increasing the velocity of the forced air at the outlet nozzle of the head of the hairdryer, the present invention increases the drying proficiency of the hairdryer without any further drain on the battery.

Air may be blown over of the battery and circuitry in a variety of ways in the present invention. The fan may be placed at the base of the handle, forcing air up through the handle, then continuing further to head, and eventually to the heating element and nozzle. It is also contemplated that the handle may simply have an air passage around the battery and circuitry that is open to the surroundings. In this way, the present invention takes advantage of Bernoulli's Principle which states that an increase in the speed of a fluid occurs simultaneously with a decrease in the pressure of the fluid. In the present invention, the air forced through the head of the housing will have a higher speed and a resulting lower pressure than the air surrounding the housing. Therefore, the surrounding air can be drawn up through the passage around the battery and circuitry and combined with the forced air in the head, because of the lower pressure in the head of the housing.

The heating element of the present invention may be as simple as a traditional resistive heating wire. A resistive heating wire, such as a nichrome wire made of an alloy of nickel, chromium, and often iron and/or other elements, acts as a resistor when placed in an electrical circuit. Nichrome wire resists the flow of electricity and converts any loss in current to heat. In the present invention a ceramic heating element is also contemplated in combination with the resistive heating wire or as the sole heating element. A ceramic heating element dissipates heat at a slower rate. Taking advantage of this property, the ceramic heating element may be preheating while charging the battery. In this manner, the AC power from a power grid may be used to initially heat the ceramic heating element. The preheated ceramic heating element will require less energy from the battery when the battery power source is relied upon to dry a user's hair.

In accordance with these and other objects, which will become apparent hereinafter, the instant invention will now be described with particular reference to the accompanying drawings.

DETAILED DESCRIPTION OF THE DRAWINGS

Figure 1:
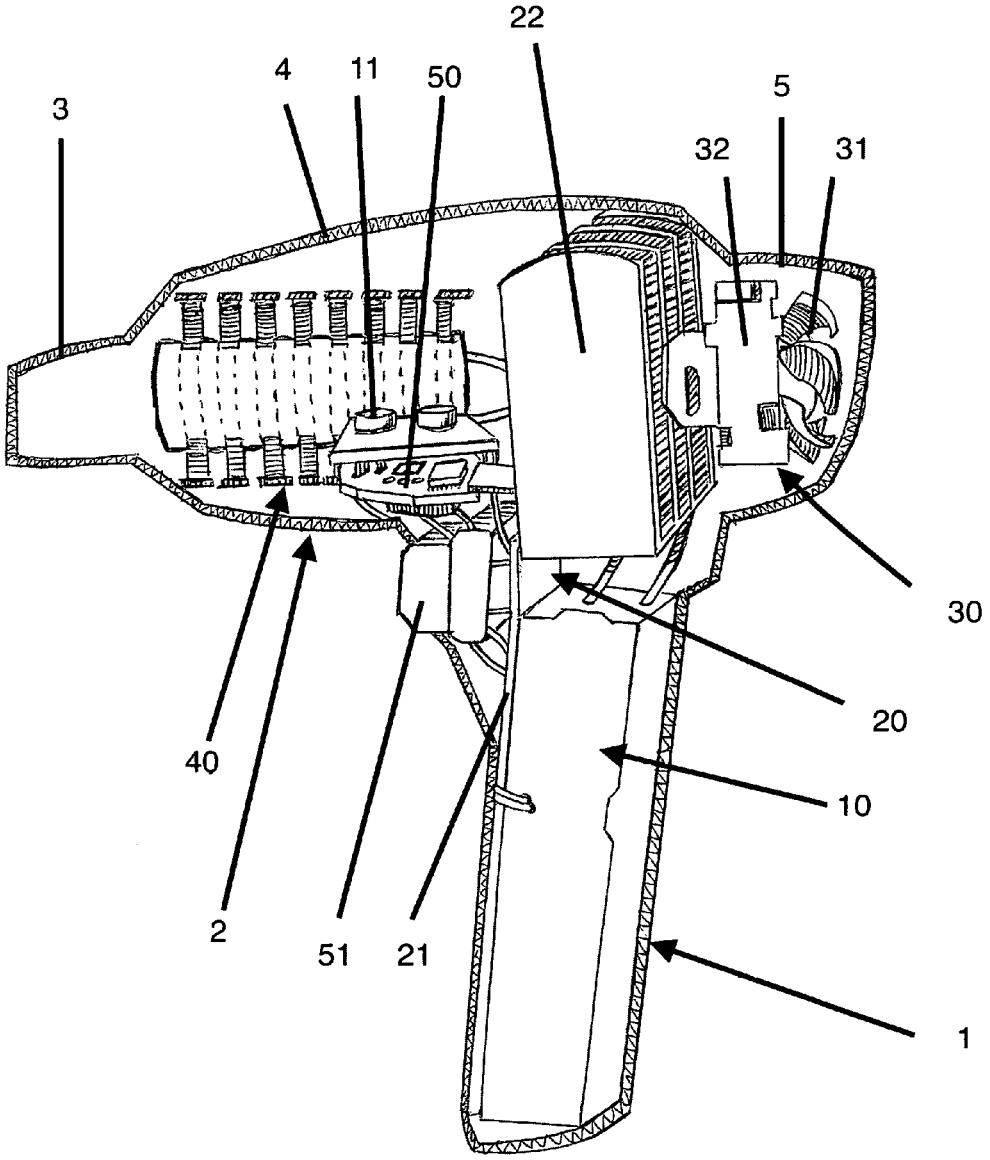
FIG. 1 is a cutaway view of a first embodiment of the present invention.

FIG. 1 shows a cutaway view of the battery powered hairdryer of the first embodiment. The battery powered hairdryer of the first embodiment comprises a housing (1 and 2), at least one battery (10 and 11), a heat sink (20), a fan (30) comprising fan blades (31) and a fan motor (32), at least one heating element (40), and circuitry (50 and 51).

The battery powered hairdryer is bound by a housing (1 and 2) comprising a handle (1) and a head (2). The head (2) is made up of at least three portions; an air outlet portion (3), a central portion (4), and an air inlet portion (5). The three portions have distinct diameters. In light of the Continuity Equation of fluids, the air outlet portion (3) has a smallest diameter. Therefore, the forced air will reach its highest velocity at the air outlet portion (3). A higher air velocity will dry the hair of a user in a shorter amount of time. The central portion (4) has a largest diameter. Therefore, the forced air will reach its lowest velocity at the central portion (4). With the forced air moving at a slower rate, the contact time between the at least one heating element (40) and the forced air can be maximized. With a longer contact time between the at least one heating element (40) and the forced air, the battery powered hairdryer of FIG. 1 will accomplish greater heat exchange from the heating element (40) to the forced air. The air inlet portion (5) is a casing for the fan (30). The housing (1 and 2) may be made of thermally insulating plastic. In this way, waste heat from any component within the housing (1 and 2) will conducted and/or convected to the head (2) to preheat the forced air.

Figure 2:
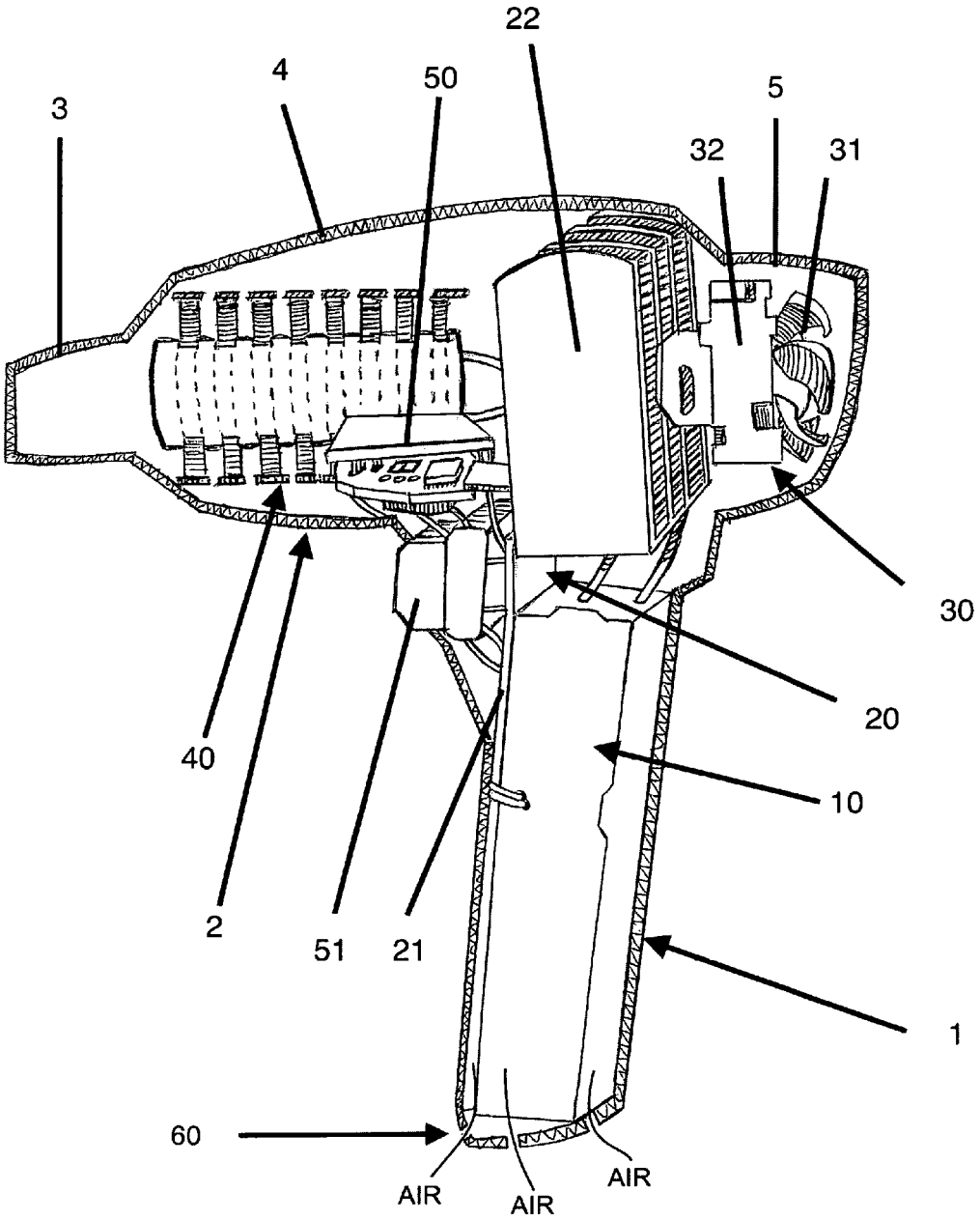
FIG. 2 is a cutaway view of a second embodiment of the present invention.

The at least one power source (10 and/or 11) is a battery comprising at least a lithium ion battery (10). A lithium ion battery is chosen for its properties of high energy density as well as it's high temperature during use. The battery powered hairdryer of FIG. 1 can be solely powered by the lithium ion battery (10) (as is shown in FIG. 2). But it is further contemplated that the battery power source (10 and/or 11) may further include an at least one supercapacitor (11). The optional at least one supercapacitor (11) is used solely for powering the at least one heating element (40). The lithium ion battery is used for powering the fan and the at least one heating element (40).

The heat sink (20) comprises a heat sink body (21) and heat sink fins (22). The heat sink (20) is made of a highly thermally conductive material, such as aluminum or copper. The heat sink body (21) is placed in contact with the lithium ion battery (10). The heat sink body (21) conducts heat away from the lithium ion battery (10) to the heat sink fins (22) arranged in the central portion of the head (2). In this way, the lithium ion battery is cooled by the heat sink body (21), the heat sink body is cooled by the heat sink fins (22), the heat sink fins are cooled by the forced air from the fan (30), thus preheating the forced air before the forced air is further heated by the at least one heating element (40). The at least one supercapacitor (11) may also be mounted to and cooled by the heat sink (20). Further circuitry, such as printed circuit board (50) and switch (51), may also be mounted to and cooled by the heat sink (20).

The at least one heating element (40) comprises a resistive heating wire. A resistive heating wire, such as a nichrome wire made of an alloy of nickel, chromium, and often iron and/or other elements, acts as a resistor when placed in an electrical circuit. A resistive heating wire made of nichrome wire efficiently converts electrical power from the lithium ion battery (10) and/or the at least one supercapacitor (11) to heat. In FIG. 1, item 40 is a resistive heating wire, a ceramic heating element, or a resistive heating wire and a ceramic heating element. A ceramic heating element dissipates heat at a slower rate. Taking advantage of this property, the ceramic heating element may be preheating while charging the battery. In this manner, the AC power from a power grid may be used to initially heat the ceramic heating element. The preheated ceramic heating element will require less energy from the battery when the battery power source is relied upon to dry a users hair.

Circuitry elements such as a printed circuit board (50) and a switch (51) complete the assembly of the battery powered hairdryer shown in the first embodiment (FIG. 1). The printed circuit board (50) may be thermally conductive, in order to maximize heat transfer to the heat sink (20) and to the forced air. Any resistive losses from the switch in the form of waste heat are also conducted to the heat sink (20).

In most applications, the high waste heat of a lithium ion battery is a drawback. In the invention of the present application, the waste heat from the lithium ion battery (10) is harnessed by a heat sink (20) and used to preheat the forced air from the fan (30), before the forced is again heated by the at least one heating element (40). Further, any resistive losses in the form of heat from the at least one supercapacitor (11), the printed circuit board (50), and the switch are conducted through the heat sink (20) and used to preheat the forced air form the fan (30). To maximize the benefit of this preheating through waste heat, the housing (1 and 2) is made of a thermally insulating plastic to harness the waste heat within the housing (1 and 2) for optimal transfer to the heat sink (20) and ultimately the forced air.

The second embodiment is shown in FIG. 2. In FIG. 1 and FIG. 2, similar reference characters and numbers are allocated to the same elements, and duplicate description thereof is omitted as needed.

As is discussed above, the battery powered hairdryer of the second embodiment (FIG. 2) is powered solely by a lithium ion battery (10). The at least one supercapacitor is intentionally omitted, as the fan (30) and at least one heating element (40) are powered only by the lithium ion battery (10). Either embodiment can be powered solely by a lithium ion battery or in combination with at least one supercapacitor, but for illustrative representation, FIG. 2 depicts the battery powered hairdryer only powered by the lithium ion battery (10).

The battery powered hairdryer of FIG. 2 uniquely includes at least one opening (60) in the bottom surface of the handle (1). The second embodiment (FIG. 2) takes advantage of Bernoulli's Principle, which states that an increase in the speed of a fluid occurs simultaneously with a decrease in the pressure of the fluid. In the present invention, the air forced through the head (2) of the housing (1 and 2) will have a higher speed and a resulting lower pressure than the air surrounding the housing (AIR). Therefore, the surrounding air (AIR) can be drawn up through the at least one opening around the battery (10) and circuitry (50 and 51) and combined with the forced air from the fan (30) in the head, because of the lower pressure in the head (2) of the housing (1 and 2).

While preferred embodiments of the present invention have been described above, it is understood that variations and modification will be apparent to those skilled in the art, without departing from the scope and spirit of the present invention. The scope of the present invention, therefore, is to be determined solely by the following claims.

What is claimed:

1. A battery operated hairdryer, comprising:

a housing comprising a handle and a head;

a fan to force air into said head;

at least one battery;

a heat extraction component to remove waste heat from said at least one battery and exhaust said waste heat into head;

wherein said heat extraction component is a heat sink comprising a heat sink body and heat sink fins;

wherein said heat sink body is located in said handle and said heat sink fins are located in said head;

wherein said forced air is heated by said exhaust heat before said forced air is heated a second time by a heating element;

wherein said forced air leaves said head of said hairdryer to dry a user's hair.

2. The battery operated hairdryer of claim 1, wherein the battery comprises a lithium ion battery.

3. The battery operated hairdryer of claim 2, wherein said lithium ion battery powers at least said fan; and wherein a supercapacitor powers the heating element.

4. The battery operated hairdryer of claim 1, wherein said heating element comprises a ceramic heating element.

5. The battery operated hairdryer of claim 4, wherein said ceramic heating element is heated while charging said at least one battery; and wherein a resistive wire heating element is only heated by said at least one battery.

6. The battery operated hairdryer of claim 1, wherein said heating element comprises a resistive wire heating element.

7. The battery operated hairdryer of claim 1, wherein said heat extraction component comprises an opening at a bottom surface of said handle that allows outside air to be drawn past said at least one battery and into said head where said outside air is combined with said forced air.

8. The battery operated hairdryer of claim 1, wherein said housing is thermally insulated.

9. The battery operated hairdryer of claim 1, wherein said head comprises at least three distinct diameters.

10. The battery operated hairdryer of claim 9, wherein said at least three distinct diameters comprises a largest diameter in a central portion of said head, a medium diameter at an air inlet portion of said head, and a smallest diameter at an air outlet portion of said head.

* * * * *